US007934541B2

(12) United States Patent
Park et al.

(10) Patent No.: US 7,934,541 B2
(45) Date of Patent: May 3, 2011

(54) PLATE FOR HEAT EXCHANGER

(75) Inventors: Taeyoung Park, Daejeon-si (KR); Kwangheon Oh, Daejeon-si (KR); Gilwoong Jun, Daejeon-si (KR); Jungjae Lee, Daejeon-si (KR)

(73) Assignee: Halla Climate Control Corporation, Daejeon-Si (KR)

( * ) Notice: Subject to any disclaimer, the term of this patent is extended or adjusted under 35 U.S.C. 154(b) by 0 days.

(21) Appl. No.: 10/558,791

(22) PCT Filed: May 28, 2004

(86) PCT No.: PCT/KR2004/001258
§ 371 (c)(1),
(2), (4) Date: Nov. 28, 2005

(87) PCT Pub. No.: WO2004/106835
PCT Pub. Date: Dec. 9, 2004

(65) Prior Publication Data

US 2006/0249281 A1 Nov. 9, 2006

(30) Foreign Application Priority Data

May 29, 2003 (KR) ..... 10-2003-0034339

(51) Int. Cl.
*F28D 1/02* (2006.01)
*F28F 9/02* (2006.01)

(52) U.S. Cl. ..... 165/153; 165/174

(58) Field of Classification Search ..... 165/153, 165/174, 176, 179, 109.1; 138/37–38; 29/890.053, 29/890.049
See application file for complete search history.

(56) References Cited

U.S. PATENT DOCUMENTS

| | | | | |
|---|---|---|---|---|
| 4,600,053 | A * | 7/1986 | Patel et al. | 165/170 |
| 4,781,248 | A * | 11/1988 | Pfeiffer | 165/167 |
| 5,062,477 | A * | 11/1991 | Kadle | 165/174 |
| 5,101,891 | A * | 4/1992 | Kadle | 165/152 |
| 5,111,878 | A | 5/1992 | Kadle | |
| 5,125,453 | A | 6/1992 | Bertrand et al. | |
| 5,409,056 | A | 4/1995 | Farry, Jr. et al. | |
| 5,620,047 | A | 4/1997 | Nishishita | |
| 6,173,764 | B1 | 1/2001 | Inoue | |
| 6,289,982 | B1 * | 9/2001 | Naji | 165/177 |
| 6,321,562 | B1 * | 11/2001 | Narahara et al. | 62/503 |
| 6,378,603 | B1 * | 4/2002 | Shimoya et al. | 165/153 |
| 6,401,804 | B1 * | 6/2002 | Shimoya et al. | 165/70 |

(Continued)

FOREIGN PATENT DOCUMENTS

EP 0 650 024 4/1995

(Continued)

*Primary Examiner* — Tho v Duong
(74) *Attorney, Agent, or Firm* — Fulbright & Jaworski L.L.P.

(57) ABSTRACT

The present invention relates to a heat exchanger plate, more particularly, in which a number of beads for imparting turbulence to refrigerant flowing through a channel of a plate are formed streamlined and guide beads arre formed in refrigerant distributing sections in order to reduce the pressure drop of refrigerant while realizing uniform refrigerant distribution. In the heat exchanger plate of a tube including a tank communicating with a channel, a number of first beads so arrayed in the plate that opposed sides are coupled to each other to impart turbulence to refrigerant flowing through the channel and refrigerant distributing sections provided in inlet and outlet sides of the channel and divided by at least one second bead to have a plurality of paths, the first beads are formed streamlined and satisfy an equation of $0.35 \leqq W/L \leqq 0.75$, wherein W is the width and L is the length.

14 Claims, 15 Drawing Sheets

U.S. PATENT DOCUMENTS

| | | | |
|---|---|---|---|
| 6,786,276 | B2 | 9/2004 | Samy et al. |
| 2003/0070797 | A1 | 4/2003 | Narahara et al. |

FOREIGN PATENT DOCUMENTS

| | | | |
|---|---|---|---|
| EP | 1 058 079 | | 12/2000 |
| EP | 1 308 687 | | 5/2003 |
| FR | 813272 | | 5/1937 |
| JP | 0 1-244282 | | 9/1989 |
| JP | 06-066487 | | 3/1994 |
| JP | 07-167581 | | 7/1995 |
| JP | 11-257877 | | 9/1999 |
| JP | 2000-346582 | | 12/2000 |
| KR | 20-0145266 | Y1 | 6/1999 |
| KR | 2001-0108764 | A | 12/2001 |

* cited by examiner

Circular Bead
(of the Prior Art)

Streamline Bead
(of the Invention)

Circular Bead
(of the Prior Art)

Streamline Bead
(of the Invention)

Refrigerant Distributing Section (of the Prior Art)

Refrigerant Distributing Section Having Guide Bead (of the Invention)

PLATE FOR HEAT EXCHANGER

This is a §371 of PCT/KR2004/001258 filed May 28, 2004, which claims priority from Korean Patent Application No. 10-2003-0034339 filed May 29, 2003.

TECHNICAL FIELD

The present invention relates to a heat exchanger plate, more particularly, in which a number of beads for imparting turbulence to refrigerant flowing through a channel of a plate are formed streamlined and guide beads are formed in refrigerant distributing sections in order to reduce the amount of the pressure drop of refrigerant while realizing uniform refrigerant distribution.

BACKGROUND ART

In general, a heat exchanger refers to a device in which an interior refrigerant passage is formed so that refrigerant exchanges heat with external air while being circulated through the refrigerant passage. The heat exchanger is used in various air conditioning devices, and is employed in various forms such as a fin tube type, a serpentine type, a drawn cup type and a parallel flow type according to various conditions in which it is used.

The heat exchanger has an evaporator-using refrigerant as heat exchange medium, which is divided into one-, two- and four-tank types:

In the one-tank type heat exchanger, tubes formed by coupling one-tank plate pairs each having a pair of cups formed at one end and a U-shaped channel defined by an inside separator are laminated alternately with heat radiation fins.

In the two-tank type heat exchanger, tubes formed by coupling two-tank plate pairs each having cups formed at the top and bottom are laminated alternately with heat radiation fins.

In the four-tank type heat exchanger, tubes formed by coupling four-tank plate pairs each having cup pairs formed at the top and bottom and two channels divided by a separator are laminated alternately with heat radiation fins.

Describing hereinafter in more detail with reference to FIGS. 1 to 3, the one-tank type heat exchanger includes a pair of parallel tanks 40 placed at the top of the exchanger and having parallel cups 14 and holes 14*a* formed in the cups 14, tubes 10 each formed by welding two single or double head plates 11 having a predetermined length of separators 13 extended from between the pair of tanks 40 to define a generally U-shaped channels 12 in which the tanks 40 are coupled together at both sides of the each tube 10, heat radiation fins 50 laminated between the tubes 10 and two end plates 30 provided at the outermost sides of the tubes 10 and heat radiation fins 50 to reinforce the same.

In each tube 10, both plates are embossed to have a number of inward-projected first beads 15 so that a turbulent flow is formed in refrigerant flowing through the channel 12.

Further, in the each tube 10, the channel 12 has refrigerant distributing sections 16 in inlet and outlet sides thereof, in which each refrigerant distributing section 16 has a plurality of paths 16*b* partitioned by at least one second beads 16*a* so that refrigerant is uniformly distributed into the channel 12.

In addition, since the double head plate is substantially same as the single head plate 11 except that one or two cups are provided in the bottom end of the double head plate, hereinafter only the single head plate 11 having two cups 14 formed in the top end will be illustrated for the sake of convenience.

The tubes 10 also include manifold tubes 20 projected into the tanks 40 to communicate with the inside of the tanks 40, in which one of the manifold tubes 20 has an inlet manifold 21 connected to an inlet pipe 2 for introducing refrigerant and the other one of the manifold tubes 20 has an outlet manifold 21 connected with an outlet pipe 3 for discharging refrigerant.

The tanks 40 having the inlet and outlet manifolds 21 are provided with partition means 60 for separating inflow refrigerant from outflow refrigerant in the refrigerant flow within the evaporator 1 as shown in FIG. 1.

As a consequence, the tanks 40 are classified into "A" part, "B" part for receiving refrigerant U-turned from the A part, "C" part communicating with the B part for receiving refrigerant, and "D" part for receiving refrigerant U-turned from the C part and then discharging the same to the outside.

When being introduced through the inlet side manifold 21, refrigerant is uniformly distributed in the A part of the tank 40 and flows through the U-shaped channels 12. In succession, refrigerant is introduced into the B part of an adjacent tank 40, and then flows into the C part of the same tank 40 through the U-shaped channels 12 of the tubes 10 and 20. Finally, refrigerant is introduced into the D part of the tank 40 having the outlet side manifold 21 to be discharged to the outside.

Through the heat exchange with the air blown between the tubes 10 and 20, the evaporator 1 as above evaporates refrigerant circulating along refrigerant lines of a cooling system while sucking and discharging the same so as to cool the air blown indoors via evaporation latent heat.

However, as shown in FIG. 3, the first beads 15 in the plates 11 are formed circularly so that stagnation points occur in the inflow direction of the first beads 15 when refrigerant is introduced and large pressure is applied to the stagnation points, thereby increasing the pressure drop of refrigerant. Also, refrigerant flowing through the channel 12 is crowded in the periphery having ununiform flow distribution.

Regarding that the evaporator 1 is being gradually miniaturized into a compact size, when the pressure drop of refrigerant is increased to impart ununiform flow distribution to refrigerant, the evaporator 1 is to have overcooled/overheated sections. In the overcooled section, a problem of icing may occur in the surface of the evaporator. In the overheated section, the temperature variation of air degrades the performance of the air conditioning system thereby causing unstableness to the air conditioning system. This also increases the temperature distribution variation of the air passing through the evaporator thereby to degrade the cooling performance.

DISCLOSURE OF THE INVENTION

The present invention has been made to solve the foregoing problems and it is therefore an object of the present invention to provide a heat exchange which has streamline first beads for imparting turbulence to refrigerant flowing through channels of plates and second beads in refrigerant distributing sections for forming guide beads extended to first rows of the first beads in order to decrease the pressure drop of refrigerant and improve the flow distribution of refrigerant into uniform state, thereby preventing overcooling/overheating as well as stabilizing an air conditioning system and improving the cooling performance thereof.

According to an aspect of the invention for realizing the above objects, there is provided a heat exchanger plate of a tube including: a tank communicating with a channel, a number of first beads so arrayed in the plate that opposed sides are coupled to each other to impart turbulence to refrigerant flowing through the channel, and refrigerant distributing sections provided in inlet and outlet sides of the channel and divided by at least one second bead to have a plurality of paths, characterized in that the first beads are formed streamlined and satisfy an equation of $0.35 \leqq W/L \leqq 0.75$, wherein W is the width and L is the length.

According to another aspect of the invention for realizing the above objects, there is also provided a heat exchanger plate of a tube including: a tank communicating with a channel, a number of first beads so arrayed in the plate that opposed sides are coupled to each other to impart turbulence to refrigerant flowing through the channel and refrigerant distributing sections provided in inlet and outlet sides of the channel and divided by at least one second bead to have a plurality of paths, characterized in that the at least one second bead is extended longer than other ones of the second beads to form a guide bead so that refrigerant flowing through refrigerant distributing section is uniformly distributed into the channel.

BEST MODE FOR CARRYING OUT THE INVENTION

Figure 1:
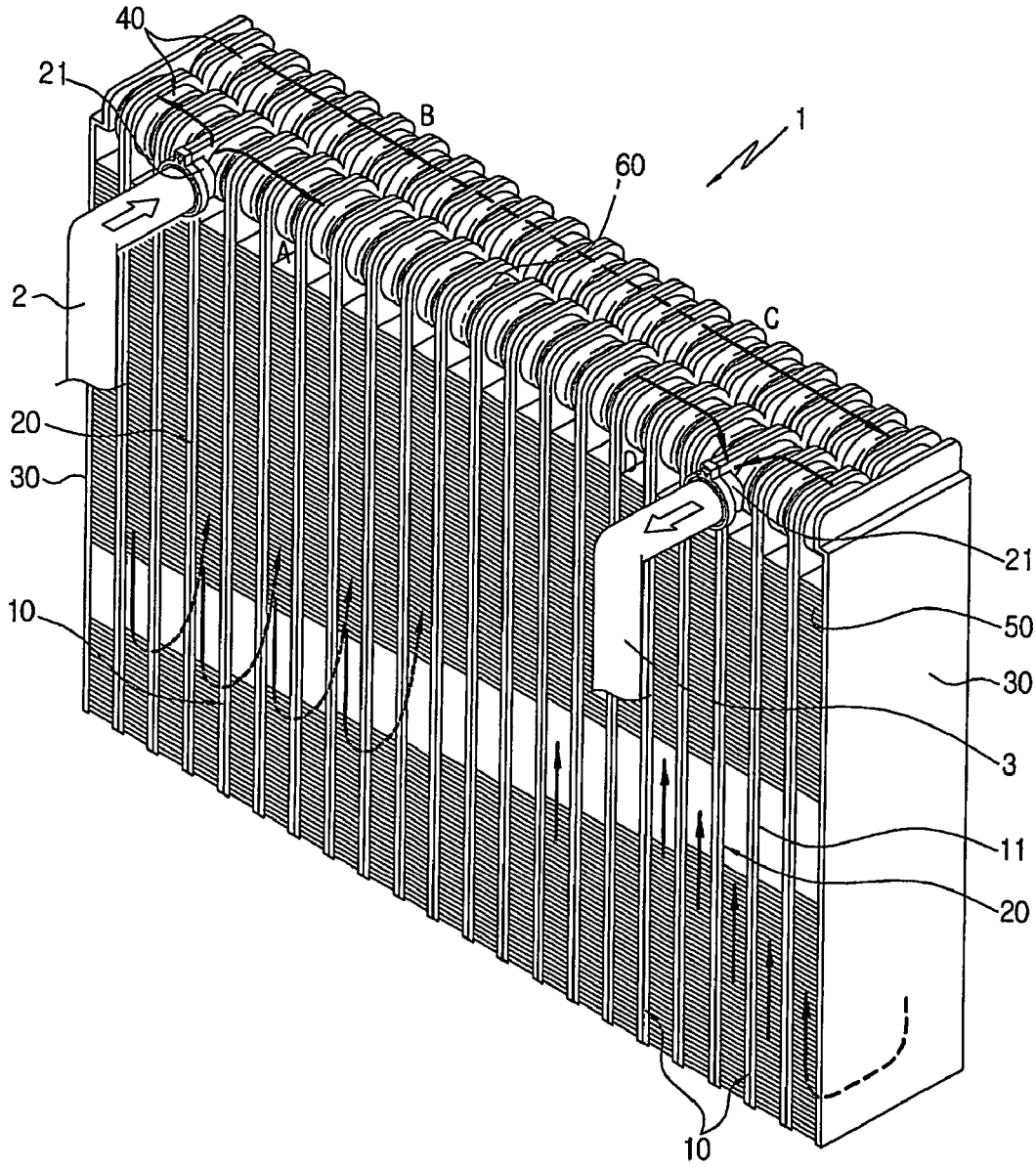
FIG. 1 is a perspective view schematically illustrating a conventional evaporator.
Figure 2:
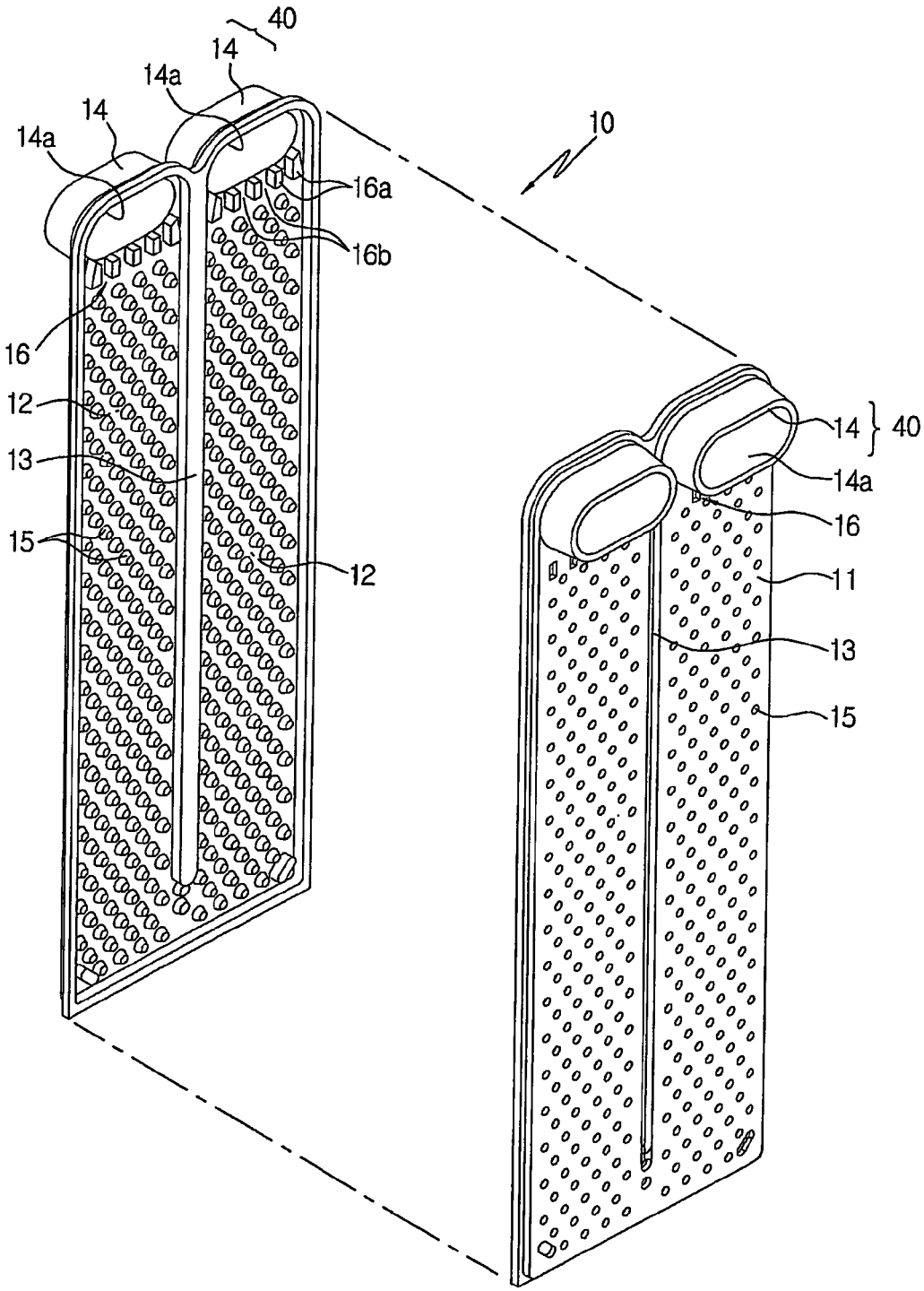
FIG. 2 is an exploded perspective view illustrating plates of conventional tubes.
Figure 3:
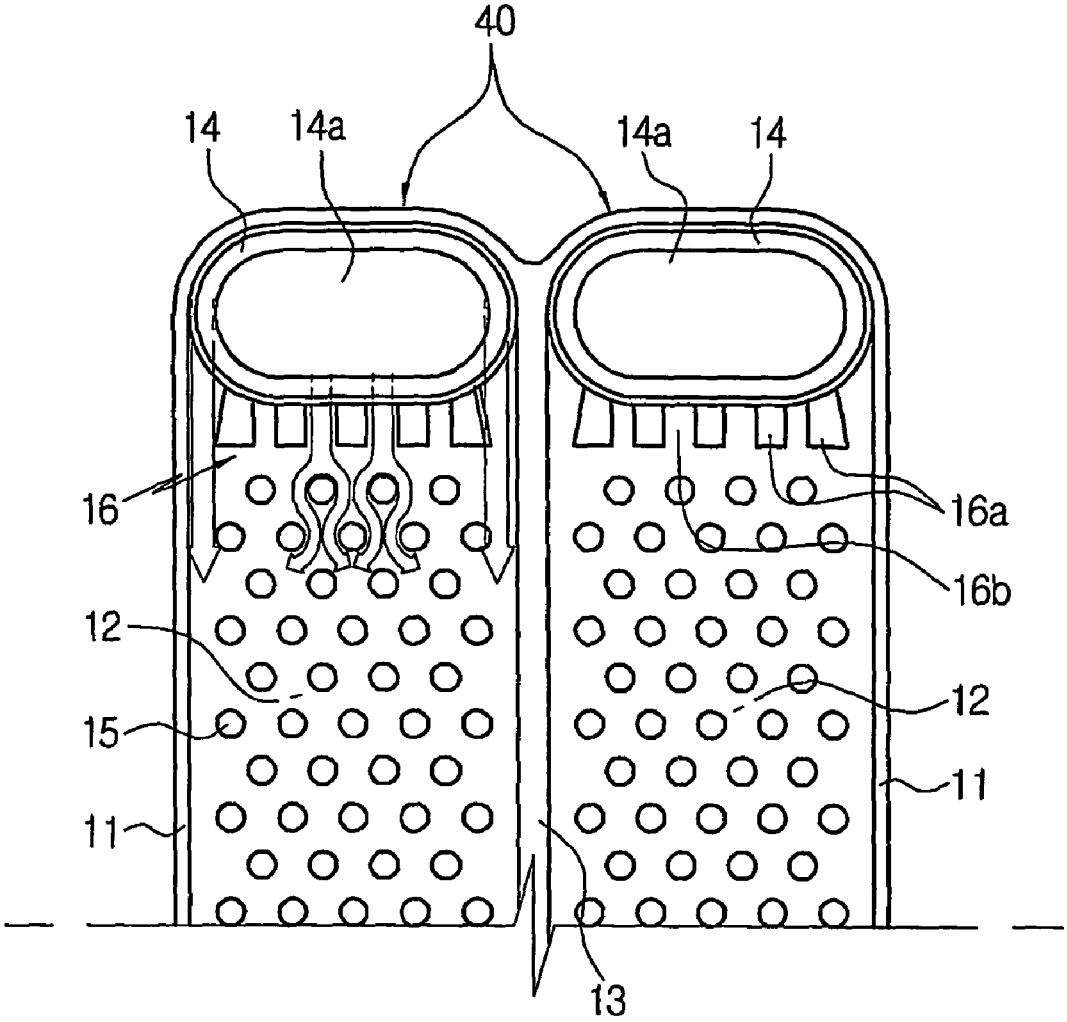
FIG. 3 is a schematic view illustrating the flow distribution of refrigerant in conventional plates.

Hereinafter preferred embodiments of the invention will be described with reference to the accompanying drawings.

The same reference numerals are used to designate the same or similar components as those of the prior art without repeated description thereof.

Figure 4:
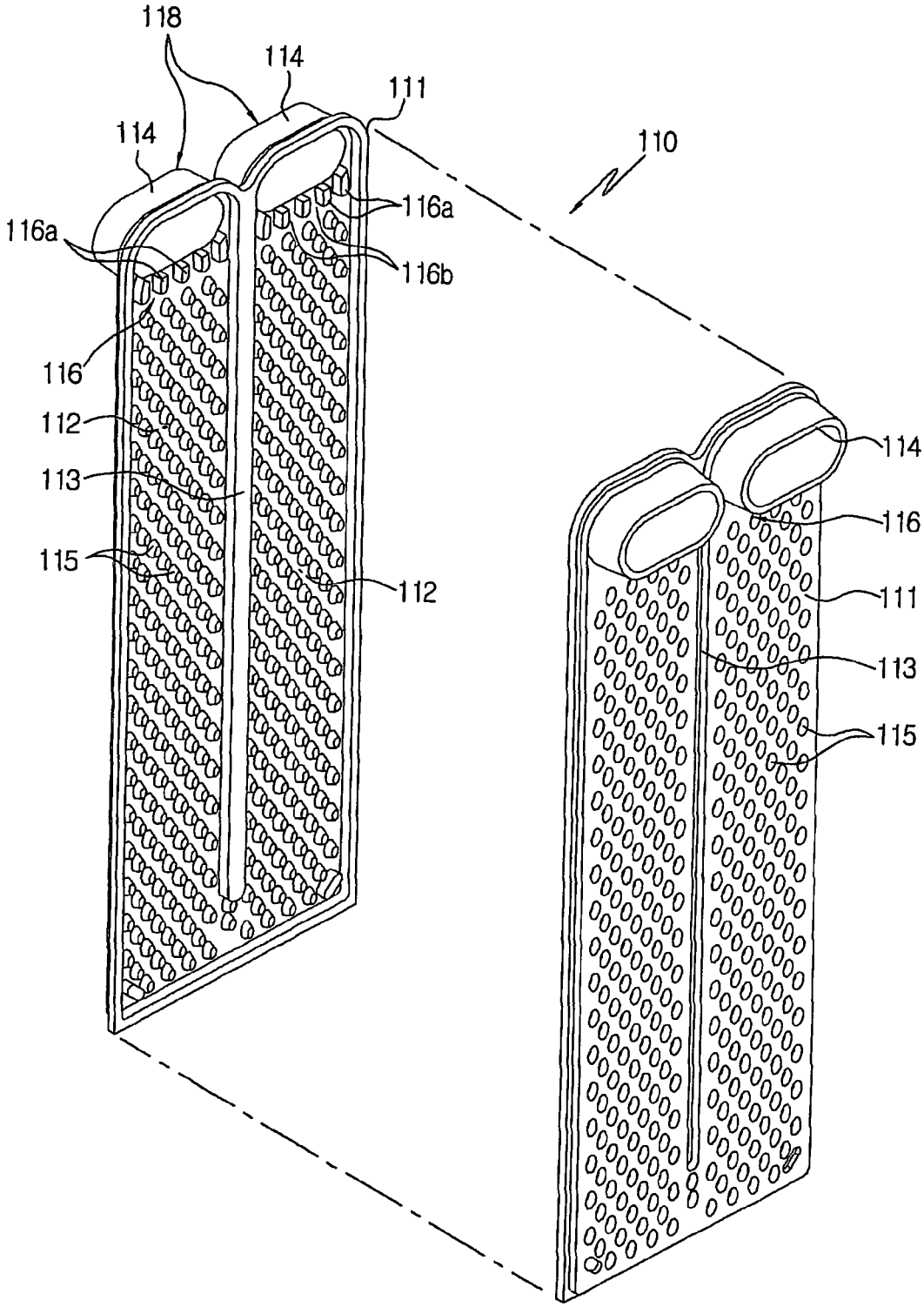
FIG. 4 is an exploded perspective view illustrating plates of tubes according to a first embodiment of the invention.
Figure 5:
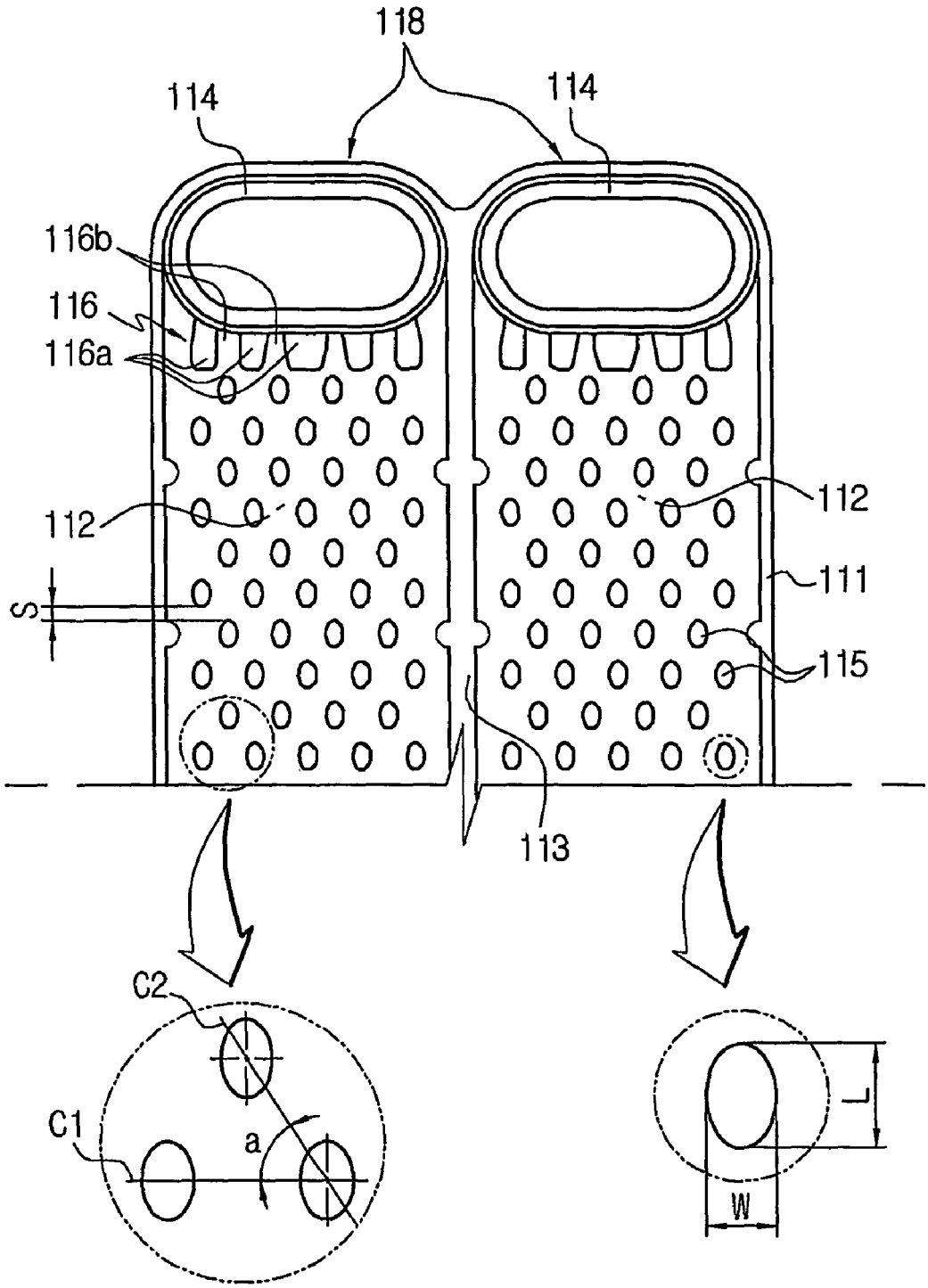
FIG. 5 illustrates a top portion of a plate according to the first embodiment of the invention, FIG. 6 compares the flow distribution of refrigerant by streamline beads of the plates according to the first embodiment of the invention with that by conventional circular beads.
Figure 6:
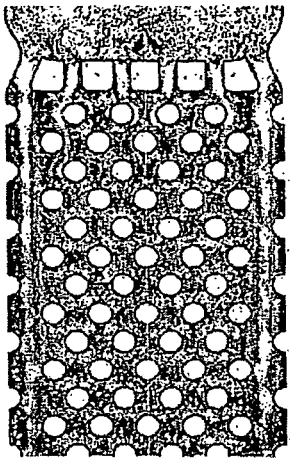
Figure 6:
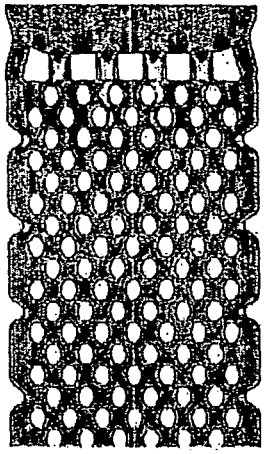
Figure 7:
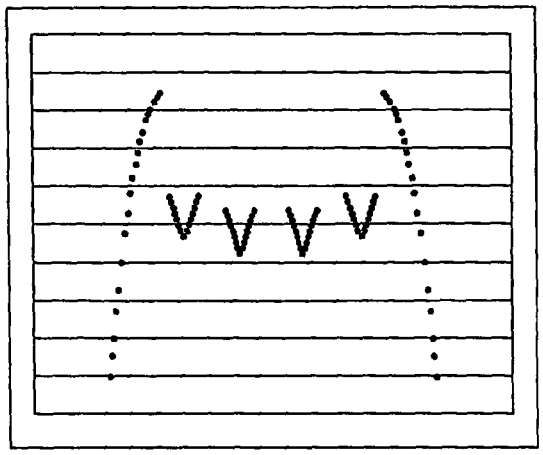
FIG. 7 illustrates graphs comparing flow rate distribution by the streamline beads of the plates with that by conventional circular beads in FIG. 6.
Figure 7:
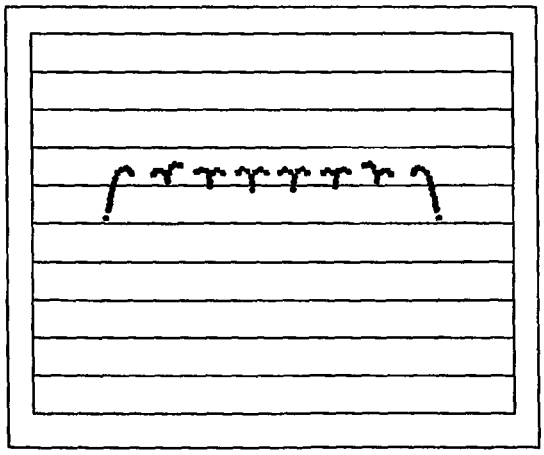
Figure 8:
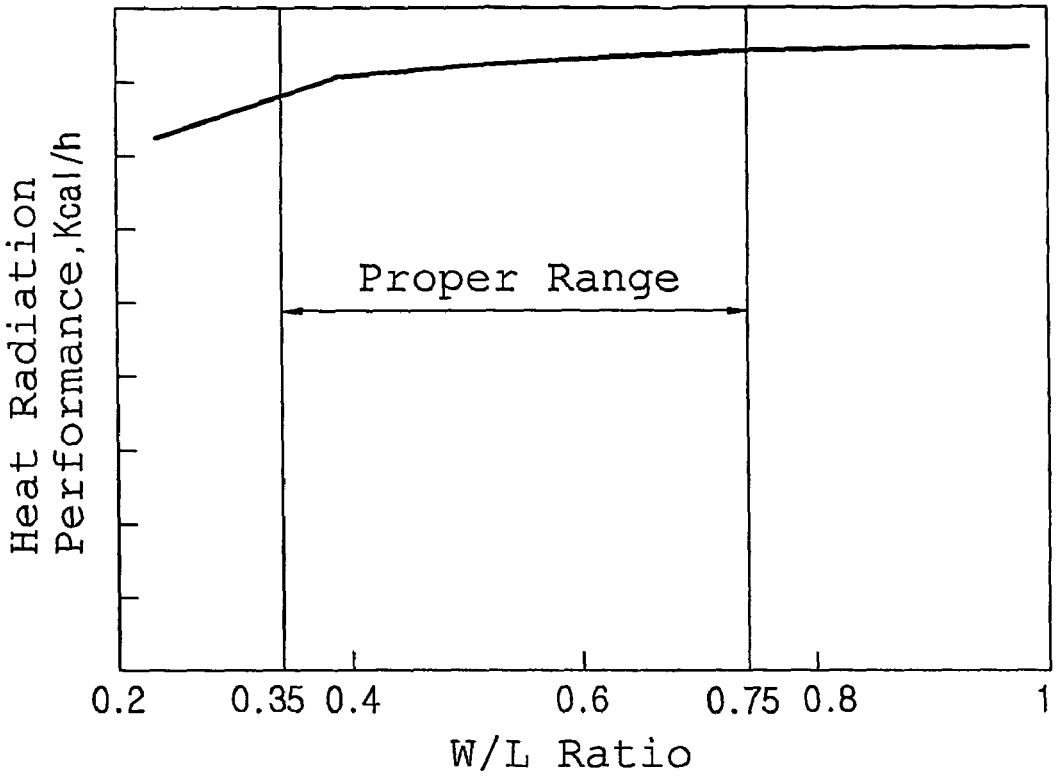
FIG. 8 is a graph illustrating the heat radiation performance about the width to length ratio of a first bead according to the invention.
Figure 9:
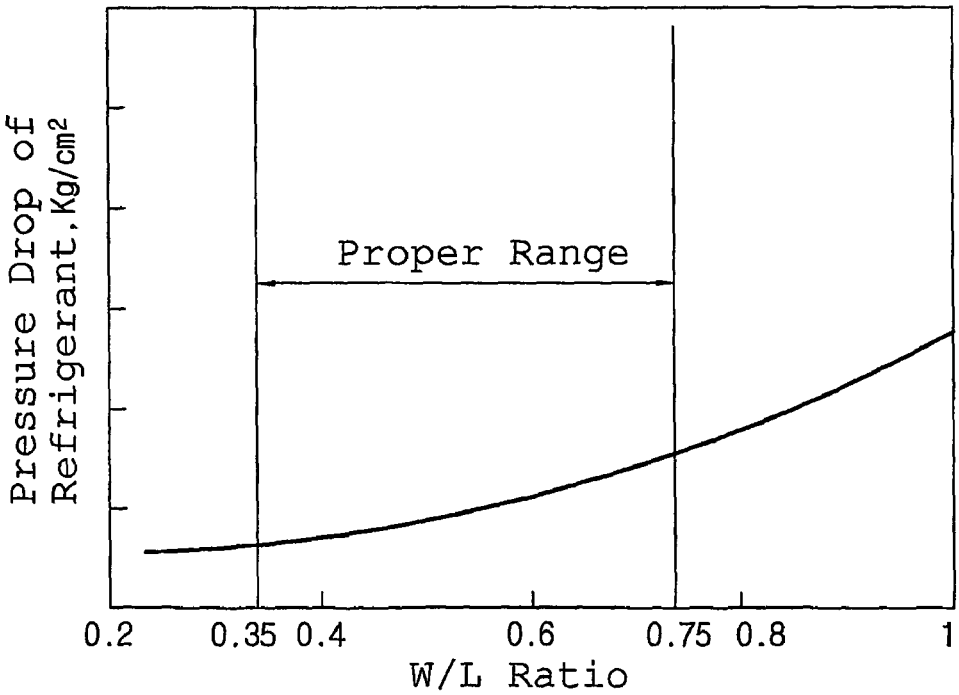
FIG. 9 is a graph illustrating the pressure drop about the width to length ratio of the first bead according to the invention.
Figure 10:
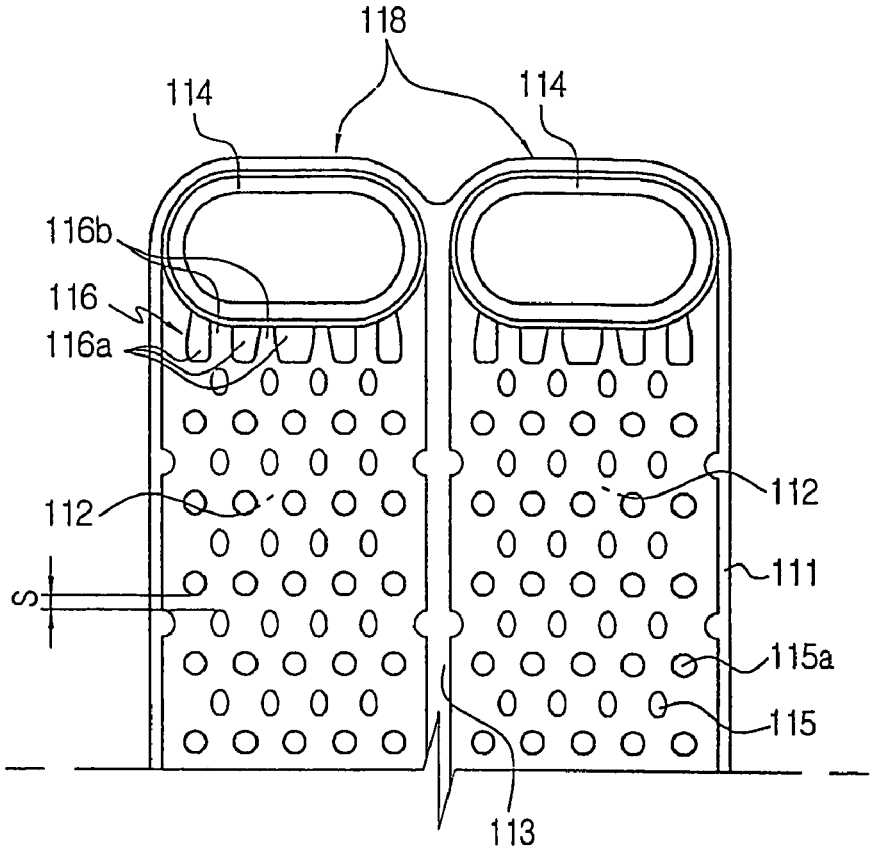
FIG. 10 illustrates a modification to an array of the first bead in a plate according to the first embodiment of the invention.
Figure 11:
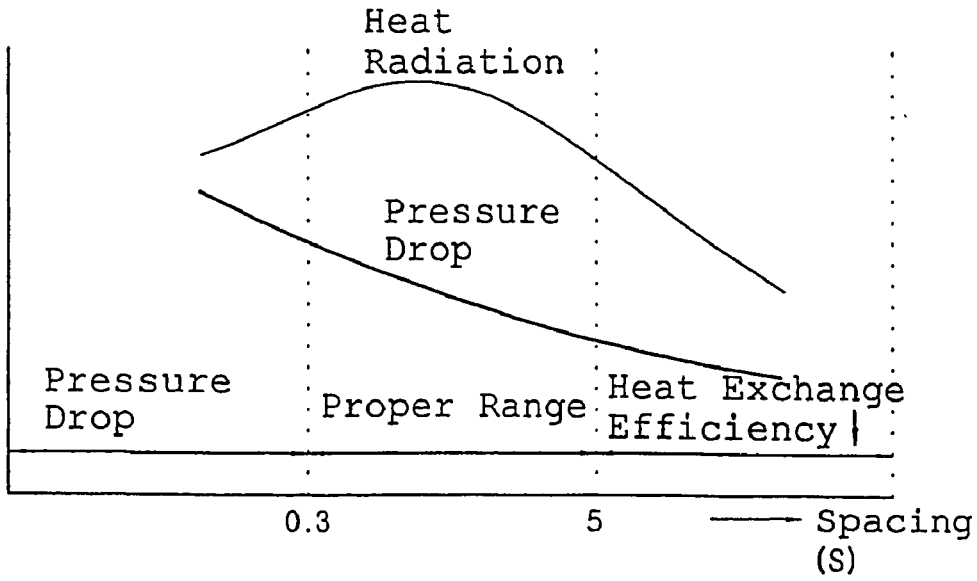
FIG. 11 is a graph illustrating amount of heat radiation and pressure drop according to the spacing between first beads of the invention.
Figure 12:
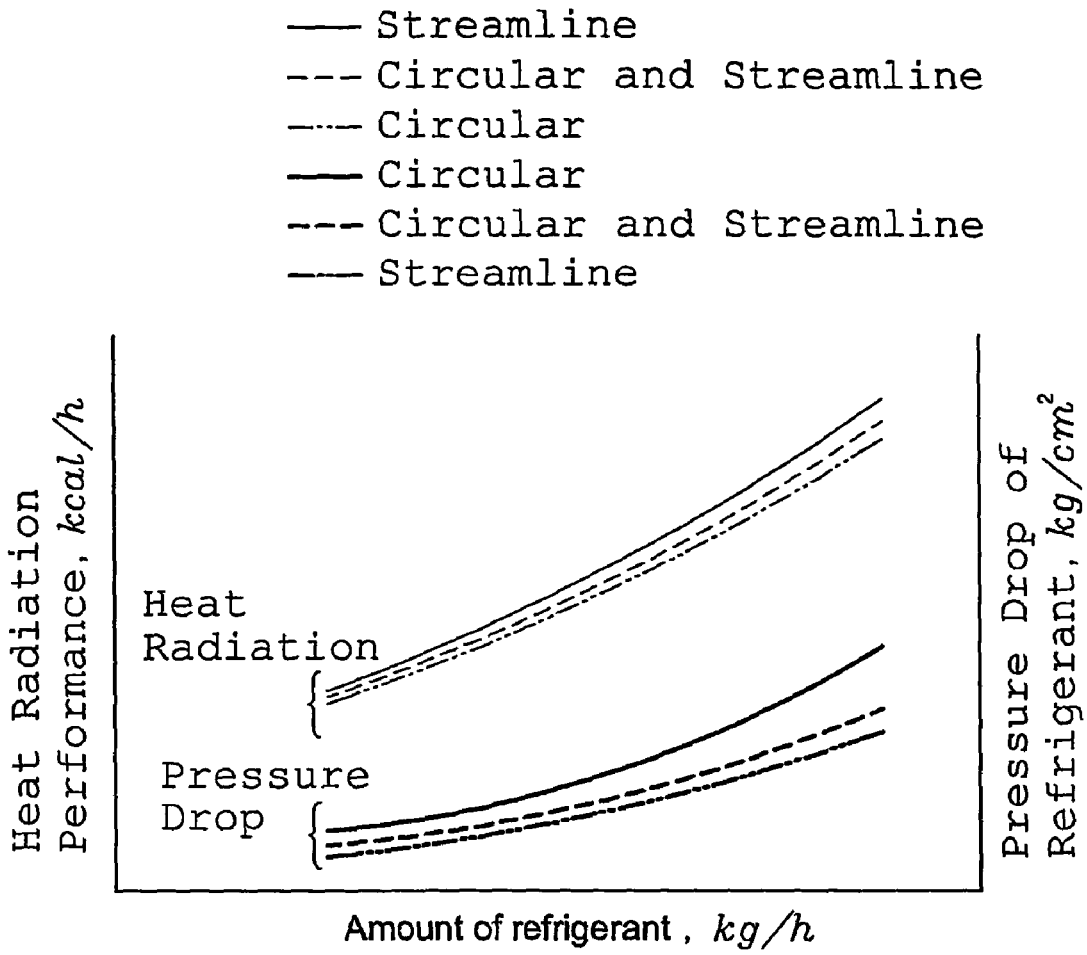
FIG. 12 is a graph illustrating heat radiation and pressure drop according to the shape of first beads with respect to the amount of refrigerant flowing through a plate channel according to the invention.

FIG. 4 is an exploded perspective view illustrating plates of tubes according to a first embodiment of the invention, FIG. 5 illustrates a top portion of a plate according to the first embodiment of the invention, FIG. 6 compares the flow distribution of refrigerant by streamline beads of the plates according to the first embodiment of the invention with that by conventional circular beads, FIG. 7 are graphs comparing flow rate distribution by the streamline beads of the plates with that by conventional circular beads in FIG. 6, FIG. 8 is a graph illustrating the heat radiation performance about the width to length ratio of a first bead according to the invention, FIG. 9 is a graph illustrating the pressure drop about the width to length ratio of the first bead according to the invention, FIG. 10 illustrates a modification to an array of the first bead in a plate according to the first embodiment of the invention, FIG. 11 is a graph illustrating amount of heat radiation and pressure drop according to the spacing between first beads of the invention, and FIG. 12 is a graph illustrating heat radiation and pressure drop according to the shape of first beads with respect to the amount of refrigerant flowing through a plate channel according to the invention.

While it is apparent that the present invention shall be applied equally to one-, two- and four-tank type evaporators 1, the following description will be made only in conjunction with the single tank type evaporator 1 for the sake of convenience.

The evaporator 1 includes a pair of parallel tanks 118 placed at the top of a heat exchanger and having parallel cups 114, tubes 110 each formed by welding two plates 111 having a predetermined length of separators 113 extended from between the pair of tanks 118 to define a generally U-shaped channels 112 in which the tanks 118 are coupled together at both sides of the each tube 110, heat radiation fins 50 (of the prior art) laminated between the tubes 110 and two end plates 30 (of the prior art) provided at the outermost sides of the tubes 110 and the heat radiation fins 50 (of the prior art) to reinforce the same.

The tubes 110 also include manifold tubes 20 (of the prior art) each formed by welding a pair of manifold plates which are projected into the tanks 118 to communicate with the inside of the tanks 118 and have manifolds 21 (of the prior art) coupled with inlet and outlet pipes 2 and 3. In the tubes 110 and 20 (of the prior art), each channel 112 has refrigerant distributing sections 116 in inlet and outlet sides thereof, in which each refrigerant distributing section 116 has a plurality of paths **116*b* partitioned by at least one second bead 116*a* so that refrigerant is uniformly distributed into the channel 112**.

Also in each plate 111, a number of first beads 115 are projected inward via embossing along the channel 112 at both sides about the separator 113 so that a turbulent flow is formed in refrigerant flowing through the channel 112. The first beads 115 are arrayed regularly and diagonally into the form of a lattice to improve the fluidity of refrigerant while creating a turbulent flow. The separators 113 and the first beads 115 in the two plates 111 are in contact with each other and then coupled together via brazing.

In the evaporator 1 as described above, the first beads 115 are preferably streamline.

This reason will be described hereinafter with reference to the drawing comparing the flow distribution of refrigerant by the circular beads 15 (of the prior art) with that by the streamline first beads 115 as shown in FIG. 6.

In the first circular beads 15 (of the prior art) as described, stagnation points are formed in inlet side regions of the first beads 15 (of the prior art), and large pressure is applied to the stagnation points increasing the magnitude of pressure drop in refrigerant. Thus, it is observed that refrigerant is crowded in the periphery creating an ununiform flow in the channel 12.

However, the first beads 115 of the invention are streamline to decrease the magnitude of pressure drop thereby preventing any large pressure at stagnation points in inlet side regions of the first beads 115. As a result, it is observed that refrigerant smoothly flows along the streamline surface of the first beads 115.

In graphs in FIG. 7 comparing the flow rate distribution by the first circular beads 15 (of the prior art) with that by the streamline first beads 115 of the invention, X-axis indicates the inside range of the plates, and Y axis indicates the flow rate.

It is observed from the graph related with the first circular beads 15 (of the prior art) that refrigerant flows fast at both sides of the plate but slowly in the center thereby to cause a large difference in the flow rate.

However, the graph related with the first beads 115 of the invention shows uniform flow rate distribution across the entire ranges.

Regarding the above results, it is apparent that the streamline first beads 115 are positively improved in not only the flow distribution of refrigerant but also the flow rate distribution of refrigerant over that of circular first beads 15 (of the prior art).

Also in the streamline first beads 115, since backwash occurs in the rear part owing to counter stream while refrigerant passes through the beads 115, the contact area to be contacted by refrigerant is increased to improve heat conduction performance while the backwash is relatively decreased in quantity to remove the dead zone by the backwash in the circular beads 15 (of the prior art).

Herein the backwash occurring during the passage of refrigerant through the first beads 115 promotes turbulence to refrigerant thereby improving heat conduction performance. However, the heavy backwash by the conventional circular beads 15 may create the dead zone and impart non-uniformity to the flow of refrigerant owing to pressure difference thereby causing the probability of overcooling/overheating. Also, the backwash if too much insignificant may lower the promotion of turbulence or heat conduction.

Accordingly, the first beads 115 of the invention are streamline to reduce the pressure at leading ends in the inflow direction of refrigerant, regulate the backwash to a proper level, improve the non-uniformity of the flow distribution of refrigerant and raise the heat conduction performance, in which the ratio W/L of the width W to the length L of each first bead 115 is limited as seen from graphs in FIGS. 8 and 9.

If the width to length ratio W/L of the first bead 115 decreases, the magnitude of pressure drop in refrigerant advantageously reduces but the heat radiation performance is degraded (for about 2 to 3%).

If the width to length ratio W/L increases, the heat radiation performance advantageously increases more or less, but the magnitude of pressure drop of refrigerant increases thereby to impart non-uniformity to the flow distribution of refrigerant.

Therefore, the first bead 115 of the invention is designed to have the width to length ratio W/L satisfying an equation of $0.35 \leqq W/L \leqq 0.75$. More preferably, the width to length ratio of the first bead 115 satisfies an equation of $0.4 \leqq W/L \leqq 0.6$ in view of productivity and performance.

It is also preferable that the width W of the first bead 115 is 1 mm or more.

If the width W of the first bead 115 is smaller than 1 mm, cracks may occur in the plates 111 in the manufacture thereby causing difficulty to the manufacture. Also, the reduction in the width W relatively increases the length L so that the interference between adjacent beads 115 may cause cracks.

In the meantime, as shown in FIG. 10, the first beads 115 arrayed in the channel 112 may be modified to have rows of circular beads 115*a* between respective rows of the streamline beads 115 so that the circular bead 115*a* rows alternate with the streamline bead rows 115.

The first beads 115 and 115*a* arrayed in the channel 112 preferably satisfy an equation $0.3\ \text{mm} \leqq S \leqq 5.0\ \text{mm}$, wherein S indicates the spacing between two longitudinally adjacent rows of the beads 115 and 115*a*.

If the spacing S between the adjacent rows of the beads 115 and 115*a* is smaller than 0.3 mm, the heat radiation is relatively high without any significant problem in heat exchange performance but the pressure drop significantly increases so that refrigerant flows crowded in the periphery or has ununiform flow distribution as shown in FIG. 11. Also, when the first beads 115 and 115*a* are formed through for example deep drawing, a crude plate may be torn causing a manufacture problem.

If the spacing S between the adjacent rows of the beads 115 and 115*a* is larger than 5.0 mm, the pressure drop decreases to improve the flow distribution of refrigerant but the heat radiation significantly decreases thereby to worsen heat exchange efficiency.

Therefore, it is preferably determined that the spacing S between the adjacent rows of the beads 115 and 115*a* satisfies a suitable range of 0.3 to 5.0 mm.

In addition, where the spacing between the longitudinally adjacent rows of the beads 115 and 115*a* is 0.3 to 5.0 mm, a center line C1 of one row of the first bead 115 and 115*a* intersects with a line C2 connecting the center of a first bead 115 or 115*a* in the other row at the shortest distance from the center of one bead 115 or 115*a* on the center line C1 at an angle $\alpha$, which preferably satisfies an equation $20° \leqq \alpha \leqq 70°$.

That is, if $\alpha$ is under 20°, the vertical distance between the first beads 115 and 115*a* becomes too small so that flowing refrigerant flows vertically down rather than being spread laterally so as to degrade the promotion of turbulence as well as reduce the heat conduction area, thereby decreasing heat radiation.

If $\alpha$ exceeds 70°, the vertical distance between the first beads 115 and 115*a* becomes too large so that the beads are reduced in number to degrade the promotion of turbulence as well as reduce the heat conduction areas, thereby decreasing heat radiation also.

FIG. 12 is a graph illustrating the heat radiation and the pressure drop varying according to the amount of refrigerant flowing through the channel in order to compare the heat radiation and the pressure drop with respect to an array of circular first beads, an array of alternating circular and streamline first beads and array of streamline beads.

As seen in FIG. 12, the streamline first beads 115 achieve the highest heat radiation but the lowest pressure drop thereby showing improvement in the flow distribution of refrigerant.

In addition, it is apparent that the streamline beads 115 are more advantageous than the circular beads at a low flow rate.

Figure 13:
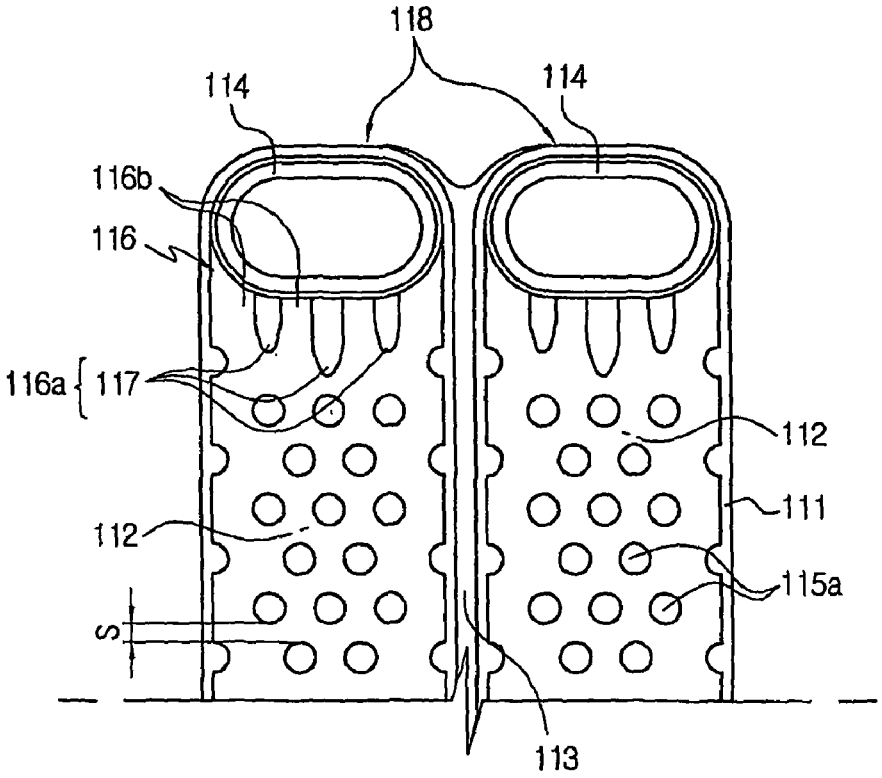
FIG. 13 illustrates a top portion of a plate according to a second embodiment of the invention, FIG. 14 are views comparing the flow distribution of refrigerant of a refrigerant distributing section having guide beads formed in the plate according to the second embodiment of the invention with that by conventional neck beads.
Figure 14:
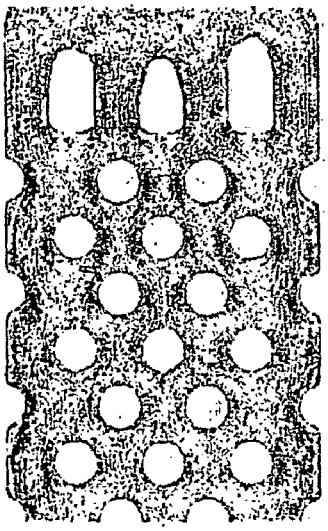
Figure 14:
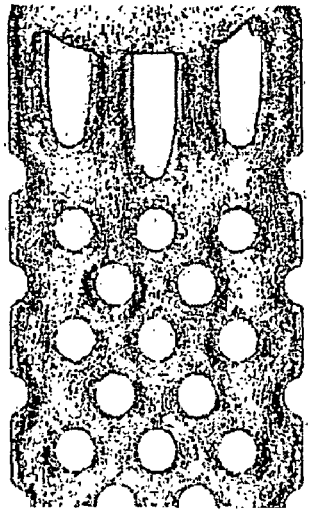

FIG. 13 illustrates a top portion of a plate according to a second embodiment of the invention; FIG. 14 are views comparing the flow distribution of refrigerant of a refrigerant distributing section having guide beads formed in the plate according to the second embodiment of the invention with that by conventional neck beads; and FIG. 15 illustrates asymmetric refrigerant distributing sections in the plate according to the second embodiment of the invention, in which the components same as those of the first embodiment will not be repeatedly described.

Figure 15:
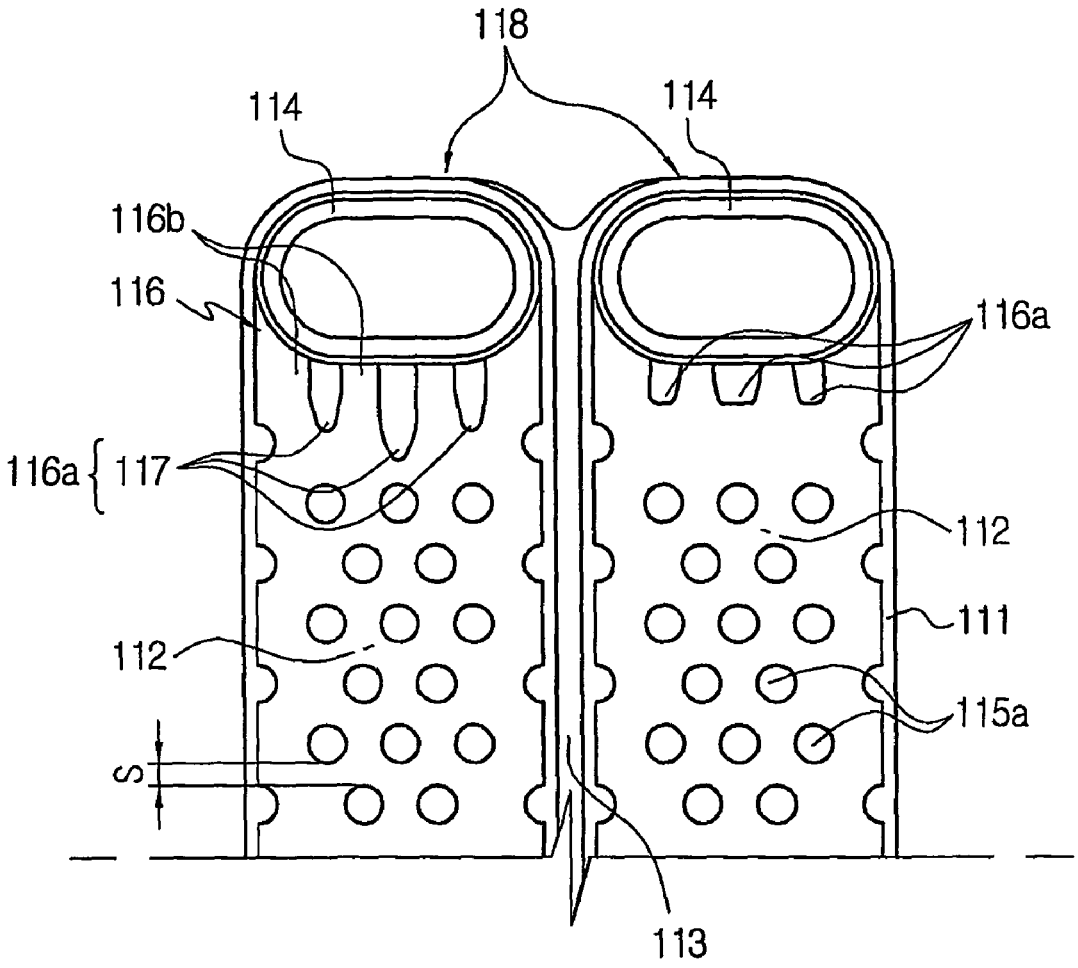
FIG. 15 illustrates asymmetric refrigerant distributing section in the plate according to the second embodiment of the invention.

As shown in FIGS. 13 to 15, in second beads 116*a* formed in a refrigerant distributing section 116, guide beads 117 are extended to a predetermined length longer than other second beads 116*a* so that refrigerant flowing through refrigerant distributing sections 116 can be uniformly distributed toward a channel 112.

The guide bead 117 is preferably formed streamlined and thus taper in width toward an end.

Preferably, a central one of the guide beads 117 is formed longer than other ones of the guide beads 117.

In the meantime, first beads 115*a* in the channel 112 are formed circular.

Instead of being circularly shaped, the first beads 115*a* may be formed streamlined as in the first embodiment, which will be described again later in the specification.

Further, the first beads 115*a* have the spacing S between longitudinally adjacent beads 115*a* in the range of 0.3 to 5.0 mm.

FIG. 14 compares the flow distribution of refrigerant by a conventional refrigerant distributing section with that of the refrigerant distributing section having the guide beads. As seen in FIG. 14, although it is required that refrigerant introduced from a tank 118 should be uniformly distributed toward the channel 112 after flowing through the refrigerant distributing section 116, the conventional refrigerant distributing section 116 (of the prior art) fails to uniformly distribute refrigerant so that refrigerant is crowded in the periphery.

On the contrary, it is observed in the refrigerant distributing section 116 having the guide beads 117 that refrigerant flowing through the refrigerant distributing section 116 is guided by the guide beads 117 to be uniformly distributed to the first beads 115*a* arrayed in the channel 112.

As a result, the guide beads 117 extended to the predetermined length can improve the flow distribution of refrigerant to prevent overcooling/overheating.

While it is possible to provide a pair of refrigerant distributing sections 116 having the guide beads 117 symmetrically in inlet and outlet sides of the channel 112, they may be provided asymmetrically as in FIG. 15. That is, the guide beads 117 may be formed only in the inlet side refrigerant distributing section 116 of the channel 112.

Figure 16:
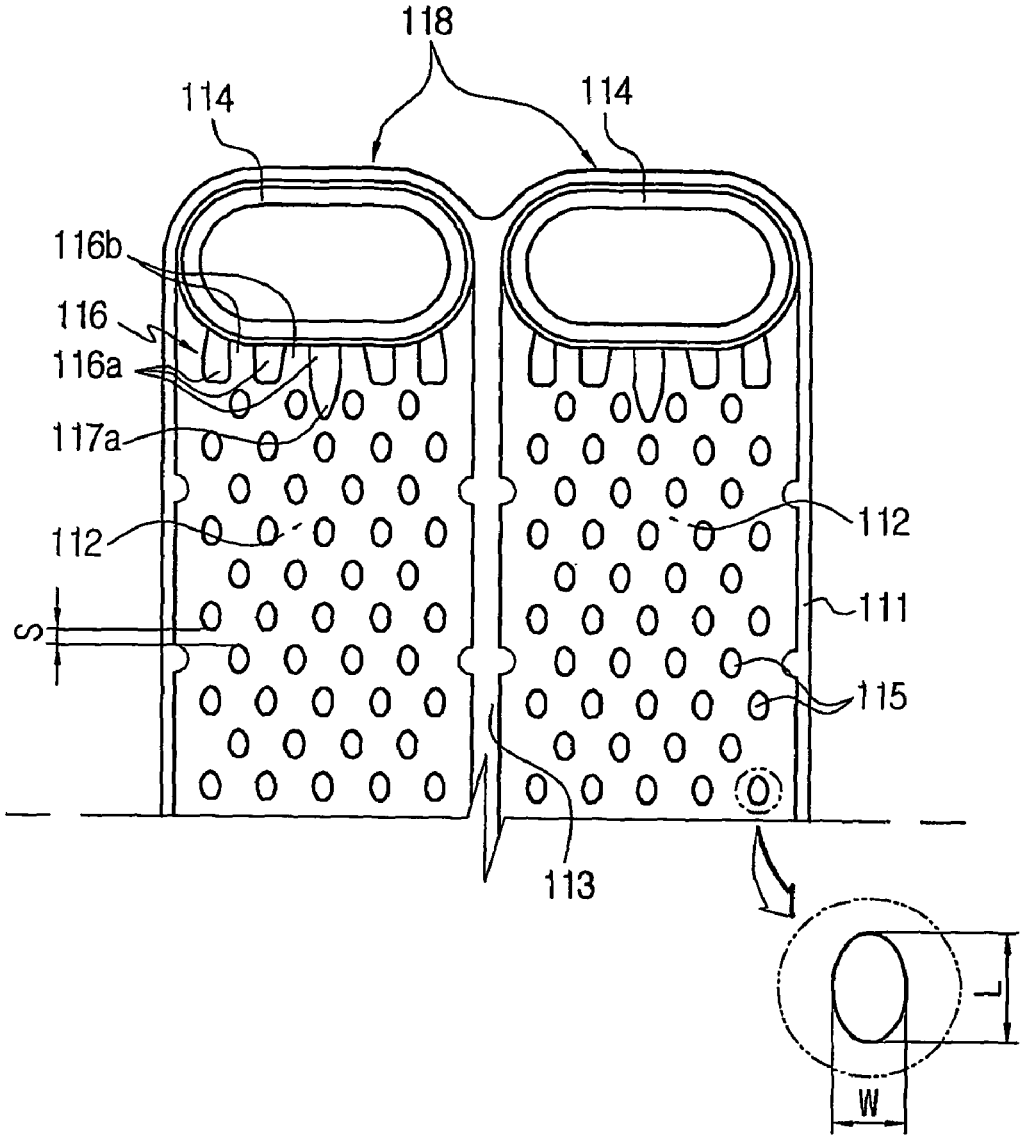
FIG. 16 illustrates a top portion of a plate according to a third embodiment of the invention.
Figure 17:
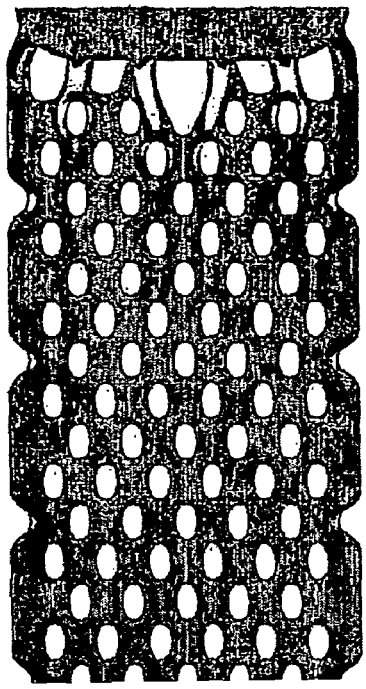
FIG. 17 illustrates the flow distribution of refrigerant in the plate in FIG. 16.
Figure 18:
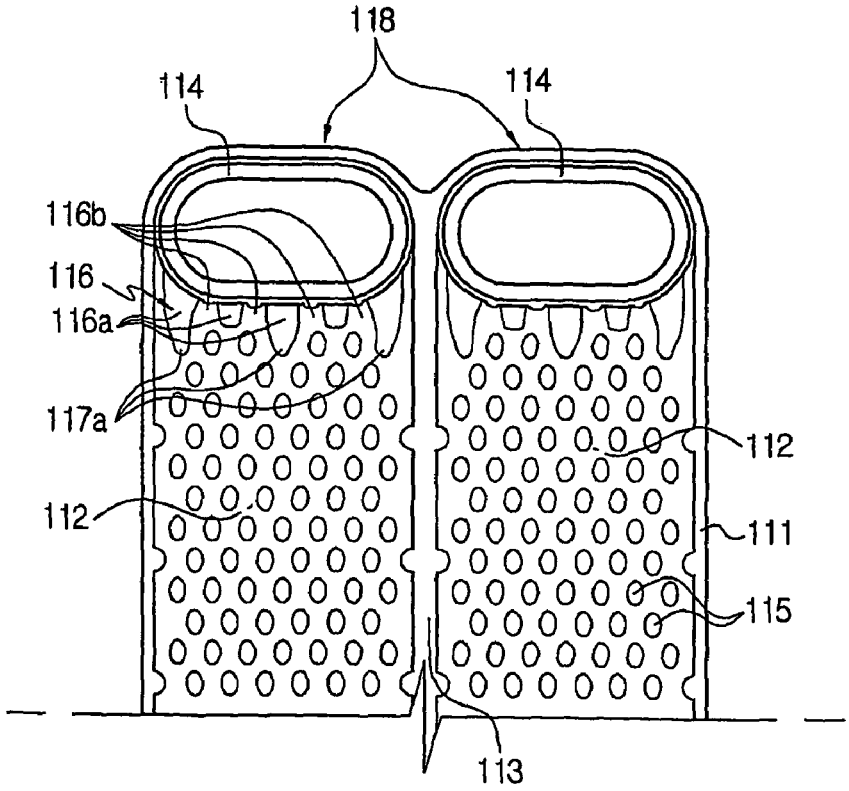
FIG. 18 illustrates a modification to a refrigerant distributing section in the plate according to the third embodiment of the invention.
Figure 19:
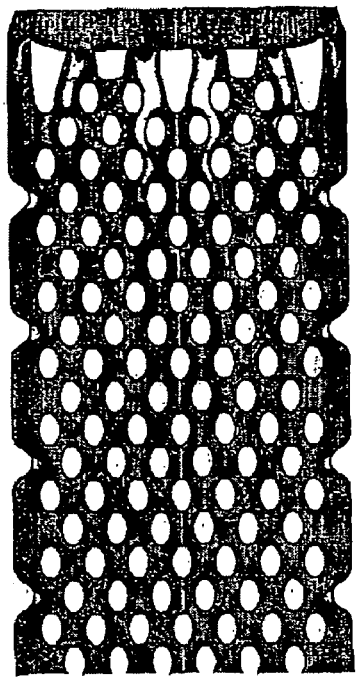
FIG. 19 illustrates the flow distribution of refrigerant for the plate in FIG. 18.
Figure 20:
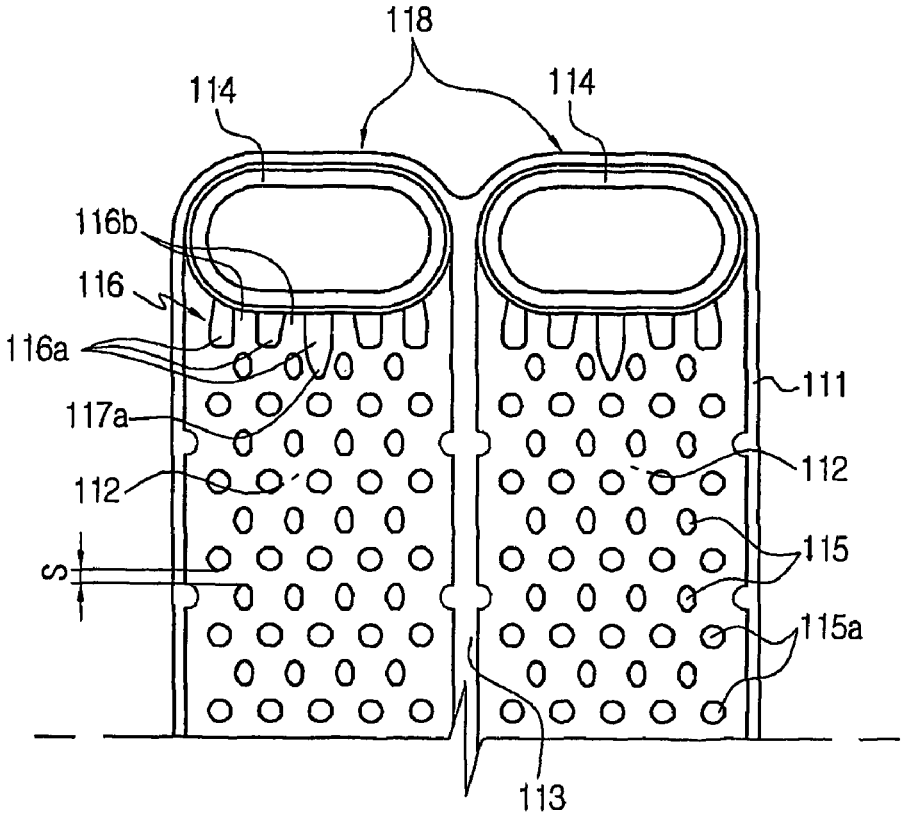
FIG. 20 illustrates a modification to an array of first bead in the plate according to the third embodiment of the invention.

FIG. 16 illustrates a top portion of a plate according to a third embodiment of the invention, FIG. 17 illustrates the flow distribution of refrigerant in the plate in FIG. 16, FIG. 18 illustrates a modification to a refrigerant distributing section in the plate according to the third embodiment of the invention, FIG. 19 illustrates the flow distribution of refrigerant for the plate in FIG. 18, and FIG. 20 illustrates a modification to an array of first bead in the plate according to the third embodiment of the invention, in which the components same as those of the first and second embodiments will not be repeatedly described.

As shown in FIGS. 16 to 20, the third embodiment has streamline first beads 115 and guide beads 117*a* among second beads 116*a* of refrigerant distributing sections 116.

That is, this embodiment embraces all effects obtainable from the streamline first beads 115 of the first embodiment and from the guide beads 117 formed in the second beads 116*a* of the refrigerant distributing sections 116 of the second embodiment in order to achieve the maximum performance.

Preferably, the width W to length L ratio W/L of a first bead 115 satisfies a suitable range defined by an equation of $0.35 \leqq W/L \leqq 0.75$ as in the above embodiment, and the spacing S between longitudinally adjacent beads 115 satisfies an equation $0.3\ \text{mm} \leqq S \leqq 5.0\ \text{mm}$.

Also, a guide bead 117*a* in the center of second beads 116*a* formed in the refrigerant distributing section 116 is extended to a first row of the first beads 115.

Preferably, one of the first beads 115 in the first row corresponding to the guide bead 117*a* is removed.

In the meantime, as shown in FIG. 18, not only the central ones of the second beads 116*a* of the refrigerant distributing section 116 but also both ones thereof may be formed into guide beads 117*a* extending to the first row of the first beads 115.

Furthermore, modifications may be made more variously other than those shown in the drawings.

Therefore, referring to the analyses of the refrigerant flow distribution shown in FIGS. 17 and 19, when flowing through paths 116*b* of the refrigerant distributing sections 116, refrigerant is introduced by the guide beads 117*a* and flows toward the first beads 115 to prevent dead zones between the second beads 116*a* and the first row of the first beads 115. This also uniformly distributes refrigerant to prevent the crowding of refrigerant in both lateral portions and overcooling/overheating.

In the meantime, as shown in FIG. 20, a number of first beads 115 and 115*a* arrayed in a channel 112 are modified so that streamline bead 115 rows alternate with circular bead rows 115*a*.

Figure 21:
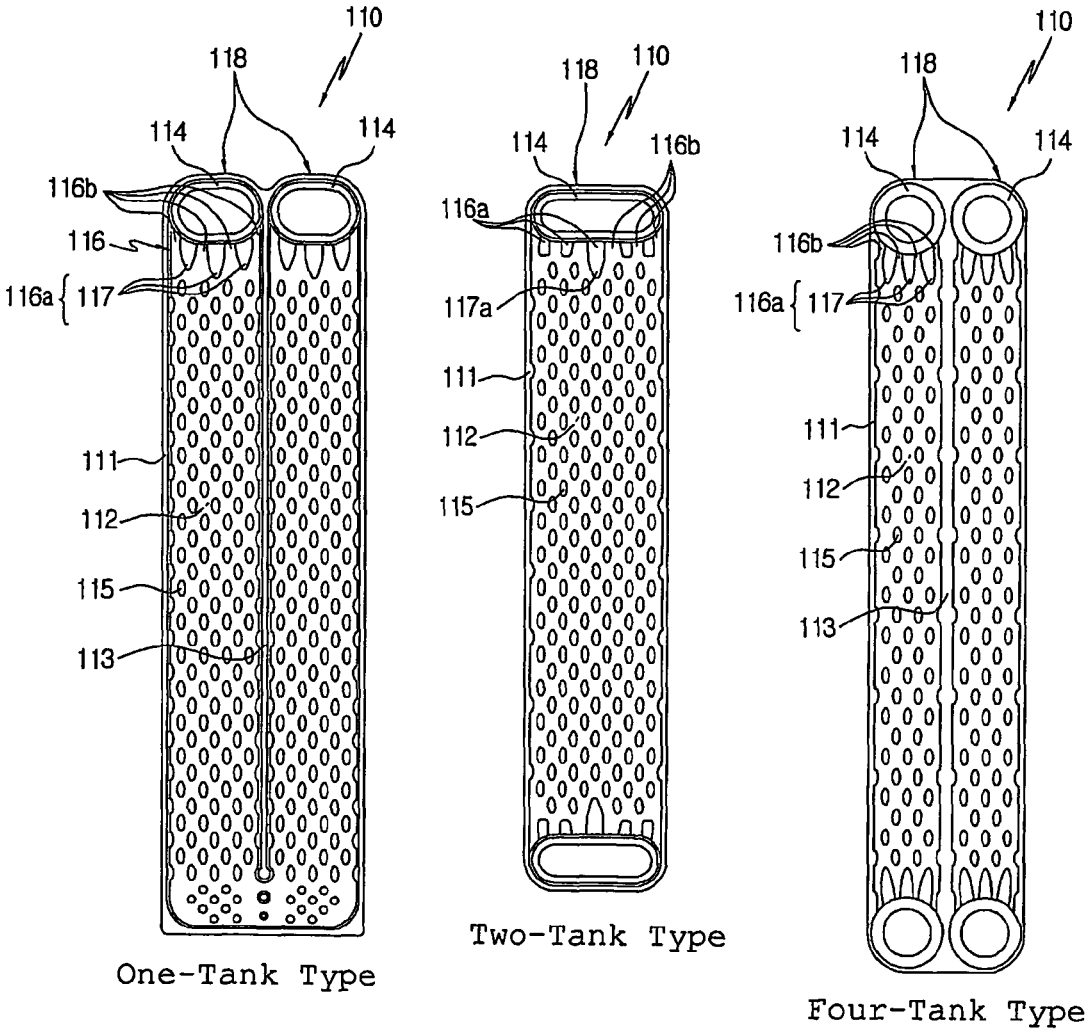
FIG. 21 illustrates one embodiment, which the plate of invention is applied to evaporator plate having one-, two- or four-tanks type.

FIG. 21 illustrates one embodiment, which the plate of invention is applied to evaporator plate having one-, two- or four-tanks type.

As show in FIG. 21, the one-tank type evaporator plate will not be described since it was described above.

In the two-tank type evaporator plate, tanks 118 are provided in the top and bottom of the tube 110, respectively, and a channel 112 linearly connects the tanks 118. In refrigerant distributing sections 116 formed in inlet and outlet sides of the channel 112, central ones of second beads 116*a* are longitudinally extended to form guide beads 117*a*, respectively.

In the four-tank type evaporator plate, a first pair of parallel tanks 118 is provided at the top of a tube, and a second pair of parallel tanks 118 is provided in the bottom of the tube. Two channels 112 are formed divided by a separator 113 that is vertically extended between the first and second pairs of tanks 118. In refrigerant distributing sections 116 provided in inlet and outlet sides of each channel 112, second beads 116*a* are extended to a predetermined length to form guide beads 117.

Meanwhile, all the first beads 115 in the one-, two- and four-tank type plates 111 are formed streamlined; but they might be formed circular.

According to the heat exchanger plate of the invention as set forth above, the first beads 115 in the plate 111 are formed streamlined and the second beads 116*a* in the refrigerant distributing sections 116 form the guide beads 117 and 117*a* extended to the first row of the first beads 115 so that refrigerant flowing through the paths 116*b* in the refrigerant distributing sections 116 is introduced by the guide beads 117 and 117*a* to be uniformly distributed to the first beads 115 arrayed in the channel 112. This structure also reduces the pressure drop but increases the heat radiation to improve the heat exchange performance thereby to facilitate the miniaturization of the evaporator 1.

While the present invention has been described in conjunction with the plate 111 of the tube 110 adopted in the evaporator 1 in which the first beads 115 are formed streamlined and the second beads 116*a* of the refrigerant distributing sections 116 form the guide beads 117 and 117*a*, it is apparent that the first beads 115 and the second beads 116*a* may be modified into various forms without departing from the scope of the invention as defined by the appended claims. Also, the same structure may be applied to the two- or four-tank type evaporator 1 obtaining the same effect as that of the invention.

According to the invention as described hereinbefore, the streamline first beads are formed to impart turbulence to refrigerant flowing through the channels of the plates while the second beads in the refrigerant distributing sections form the guide beads extended to the first rows of the first beads in order to decrease the pressure drop of refrigerant but increasing the heat radiation thereof thereby improving the heat exchange efficiency.

Furthermore, both the flow distribution of refrigerant and the temperature distribution of passed air are uniformly improved to prevent the evaporator from overcooling/overheating as well as stabilize an air conditioning system while improving its performance.

Moreover, the pressure drops of refrigerant decreases to facilitate the miniaturization of the evaporator into a compact size.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A heat exchanger comprising a tube formed by two plates and including a cup forming a tank communicating with a channel, a number of first beads projected inward and so arrayed in each plate such that opposed sides of the first beads are coupled to each other to impart turbulence to refrigerant flowing through the channel and refrigerant distributing sections provided in inlet and outlet sides of the channel and divided by a plurality of second beads projected inward and coupled to each other to have a plurality of paths around the second beads, wherein at least one of the second beads is extended further towards an adjacent row of the first beads than the other second beads and is a guide bead, wherein the first beads in the adjacent row are aligned in a horizontal direction and wherein a perpendicular distance between the guide bead and a horizonal line of an adjacent array of the first beads is shorter than a perpendicular distance between the other second beads and the horizontal line of the adjacent array of the first beads, so that refrigerant flowing through refrigerant distributing section is uniformly distributed into the channel, wherein at least one of the second beads is integrally projected from the cup toward the channel and separate the paths, and wherein the first and second beads are arranged in the channel and let the refrigerant flowing through the channel flow around and contact the first and second beads wherein a pair of parallel tanks are provided at a top of the tube, the channel forms a U-shaped channel by a separator extended from between the pair of tanks to vertically partition a predetermined portion.

2. The heat exchanger according to claim 1, wherein the guide bead is formed streamlined and tapers in width toward an end.

3. The heat exchanger according to claim 1, wherein the refrigerant distributing sections provided in the inlet and outlet sides of the channel are symmetric with each other.

4. The heat exchanger according to claim 1, wherein the refrigerant distributing sections provided in the inlet and outlet sides of the channel are asymmetric with each other.

5. The heat exchanger according to claim 1, wherein the first beads are formed streamlined and satisfy an equation of $0.35 \leqq W/L \leqq 0.75$, wherein W is the width and L is the length.

6. The heat exchanger according to claim 5, wherein the first beads have a spacing S between longitudinally adjacent ones of the beads, and the spacing S satisfies an equation of $0.3\ \text{mm} \leqq S \leqq 5.0\ \text{mm}$.

7. The heat exchanger according to claim 6, wherein a center line C1 of one row of the first bead intersects with a line C2 connecting the center of a first bead in the other row at the shortest distance from the center of one bead on the center line C1 at an angle a satisfying an equation $20° \leqq \alpha \leqq 70°$.

8. A heat exchanger comprising a tube formed by two plates and including a cup forming a tank communicating with a channel, a number of first beads projected inward and so arrayed in each plate such that opposed sides of the first beads are coupled to each other to impart turbulence to refrigerant flowing through the channel and refrigerant distributing sections provided in inlet and outlet sides of the channel and divided by a plurality of second beads projected inward and coupled to each other to have a plurality of paths around the second beads, wherein at least one of the second beads is extended further towards an adjacent row of the first beads than the other second beads and is a guide bead, wherein the first beads in the adjacent row are aligned in a horizontal direction and wherein a perpendicular distance between the guide bead and a horizontal line of the adjacent array of the first beads is shorter than a perpendicular distance between the other second beads and the horizontal line of the adjacent array of the first beads, so that refrigerant flowing through refrigerant distributing section is uniformly distributed into the channel, wherein at least one of the second beads is integrally projected from the cup toward the channel and separate the paths, and wherein the first and second beads are arranged in the channel and let the refrigerant flowing through the channel flow around and contact the first and second beads wherein two pair of parallel tanks are provided at a top and a bottom of the tube, respectively, and the channel is partitioned into two separate channels by a separator vertically formed between the pairs of tanks.

9. The heat exchanger according to claim 8, wherein the guide bead is formed streamlined and tapers in width toward an end.

10. The heat exchanger according to claim 8, wherein the refrigerant distributing sections provided in the inlet and outlet sides of the channel are asymmetric with each other.

11. The heat exchanger according to claim 8, wherein the guide bead is extended to a first row of the first beads.

12. The heat exchanger according to claim 8, wherein the first beads are formed streamlined and satisfy an equation of $0.35 \leqq W/L \leqq 0.75$, wherein W is the width and L is the length.

13. The heat exchanger according to claim 12, wherein the first beads have a spacing S between longitudinally adjacent ones of the beads, and the spacing S satisfies an equation of $0.3\ \text{mm} \leqq S \leqq 5.0\ \text{mm}$.

14. The heat exchanger according to claim 13, wherein a center line C1 of one row of the first bead intersects with a line C2 connecting the center of a first bead in the other row at the shortest distance from the center of one bead on the center line C1 at an angle $\alpha$, satisfying an equation $20° \leqq \alpha \leqq 70°$.

* * * * *